US012319889B2

(12) United States Patent
Colombo

(10) Patent No.: US 12,319,889 B2
(45) Date of Patent: Jun. 3, 2025

(54) FOOD GRADE LUBRICANT FOR CONVEYING FOOD CONTAINERS

(71) Applicant: Chemical Systems Of Orlando, Inc., Zellwood, FL (US)

(72) Inventor: Russel Gerald Colombo, Zellwood, FL (US)

(73) Assignee: CHEMICAL SYSTEMS OF ORLANDO, INC., Zellwood, FL (US)

( * ) Notice: Subject to any disclaimer, the term of this patent is extended or adjusted under 35 U.S.C. 154(b) by 0 days.

(21) Appl. No.: 18/382,674

(22) Filed: Oct. 23, 2023

(65) Prior Publication Data

US 2024/0141253 A1 May 2, 2024

Related U.S. Application Data

(60) Provisional application No. 63/419,472, filed on Oct. 26, 2022.

(51) Int. Cl.

| | |
|---|---|
| ***C10M 173/02*** | (2006.01) |
| ***C10N 30/00*** | (2006.01) |
| ***C10N 30/06*** | (2006.01) |
| ***C10N 50/00*** | (2006.01) |
| ***C10N 70/00*** | (2006.01) |

(52) U.S. Cl.

CPC ..... *C10M 173/025* (2013.01); *C10M 2205/0285* (2013.01); *C10M 2207/123* (2013.01); *C10M 2207/124* (2013.01); *C10M 2207/141* (2013.01); *C10M 2207/289* (2013.01); *C10N 2030/06* (2013.01); *C10N 2030/40* (2020.05); *C10N 2030/62* (2020.05); *C10N 2050/011* (2020.05); *C10N 2070/00* (2013.01)

(58) Field of Classification Search

CPC ..... C10N 2030/06; C10N 2030/40; C10N 2030/62; C10N 2050/011; C10N 2070/00; C10M 173/025; C10M 2005/0285; C10M 2007/123; C10M 2007/124; C10M 2007/141; C10M 2007/289

See application file for complete search history.

(56) References Cited

U.S. PATENT DOCUMENTS

| | | | | |
|---|---|---|---|---|
| 4,995,884 | A | 2/1991 | Ross et al. | |
| 6,576,298 | B2 | 6/2003 | Bennett et al. | |
| 6,673,755 | B2 | 1/2004 | Wei et al. | |
| 6,858,567 | B2 * | 2/2005 | Akao | C10M 169/044 508/579 |
| 7,741,257 | B2 | 6/2010 | Valencia Sil et al. | |
| 7,745,381 | B2 | 6/2010 | Valencia Sil et al. | |
| 8,058,215 | B2 | 11/2011 | Valencia Sil et al. | |
| 8,211,838 | B2 | 7/2012 | Valencia Sil et al. | |
| 8,216,984 | B2 | 7/2012 | Valencia Sil et al. | |
| 8,455,409 | B2 | 6/2013 | Valencia Sil et al. | |
| 8,765,648 | B2 | 7/2014 | Valencia Sil et al. | |
| 8,895,490 | B2 | 11/2014 | Dole et al. | |
| 9,365,798 | B2 | 6/2016 | Valencia Sil et al. | |
| 9,562,209 | B2 | 2/2017 | Valencia Sil et al. | |
| 9,926,511 | B2 | 3/2018 | Valencia Sil et al. | |
| 10,030,210 | B2 | 7/2018 | Valencia Sil et al. | |
| 10,696,915 | B2 | 6/2020 | Arriaga et al. | |
| 10,815,448 | B2 | 10/2020 | Valencia Sil et al. | |
| 10,851,325 | B2 | 12/2020 | Valencia Sil et al. | |
| 2004/0241309 | A1 | 12/2004 | Garmier | |
| 2008/0242567 | A1 * | 10/2008 | Ornelas Vicencio | C10M 169/04 508/463 |
| 2019/0240148 | A1 | 8/2019 | Riefler et al. | |
| 2021/0079313 | A1 | 3/2021 | Valencia Sil et al. | |
| 2021/0102140 | A1 | 4/2021 | Valencia Sil et al. | |

FOREIGN PATENT DOCUMENTS

| | | | |
|---|---|---|---|
| CN | 108165342 | A | 6/2018 |
| GB | 1499491 | A | 2/1978 |
| JP | S6462399 | | 7/1996 |
| JP | 2018012782 | A * | 1/2018 |
| JP | 2018012782 | B | 9/2020 |

OTHER PUBLICATIONS

English machine translation of JP 2018-12782 A (Year: 2018).*

Nippon Steel PAO Brochure, retrieved from the internet at <https://web.archive.org/web/20211208223936/https://www.nscm.nipponsteel.com/chemicals/pdf/pao.pdf> on Feb. 14, 2025 (Year: 2021).*

International Search Report of Feb. 13, 2024 for PCT/US2023/035696.

* cited by examiner

*Primary Examiner* — James C Goloboy

(74) *Attorney, Agent, or Firm* — GrayRobinson, P.A.

(57) ABSTRACT

A food grade lubricant composition includes an emulsion having 85%-95% w/w water, 1%-4% w/w polyalphaolefin 4, 1%-4% w/w sorbitan monolaurate, 2%-5% w/w polyoxyethylene 20 sorbitan monolaurate, and a food grade preservative.

19 Claims, No Drawings

FOOD GRADE LUBRICANT FOR CONVEYING FOOD CONTAINERS

CROSS-REFERENCE TO RELATED APPLICATION

This claims the benefit of priority from Application No. 63/419,472, filed Oct. 26, 2022, which is incorporated by reference in its entirety.

FIELD

This relates to the field of food processing and, more particularly, to lubricating food container conveyors.

BACKGROUND

Food products are sold in many different types of containers, including bottles and cans made of metal, glass, plastic, PET (polyethylene terephthalate), or HDPE (high density polyethylene). In a food processing plant, empty and full containers are conveyed along conveyors between processing stages at a high rate. Conveyors are typically made of metal and/or plastic materials. As containers move on the conveyer, friction can retard their and they can be marred from bumping into each other. Different types of lubricants have been introduced to mitigate these problems.

Conventional "wet lubricants," which contain at least 50% water, are diluted before use, often at dilution ratios of at least 100:1. The problem with such wet lubricants is that they require a large amount of water that either has to be recycled or disposed of. Further, variations in the chemistry of water used for dilution can hinder the performance of the wet lubricant.

Conventional "dry lubricants," which contain less than 50% water have been introduced to try to overcome such problems with wet lubricants. Dry lubricants are typically silicone-based and do not require aqueous dilution. But the problem with certain dry lubricants is that silicone is not an effective lubricant for all types of container materials or conveyor surfaces.

BRIEF SUMMARY

Because food conveyor lubricants directly contact food containers, it may be possible for the lubricant to contaminate the food. To maximize food safety, it would be advantageous to use a lubricant composed of food grade materials in case of food contact. What is needed is a food grade lubricant having >50% water that does not need to be diluted prior to use and that can provide effective lubrication on many different container materials and conveyor surfaces. The lubricant should be composed of food grade materials for use in conveying food containers but should also supply a low coefficient of friction between the containers and the conveyor. It was difficult to identify and combine food grade ingredients to create such a lubricant composition because water and hydrophobic lubricants are not miscible. This was achieved by using a polyalphaolefin 4 lubricant and a blend of emulsifiers to create a stable emulsion.

An example of such a food grade lubricant composition includes an emulsion having 85%-95% w/w water, 1%-4% w/w polyalphaolefin 4, 1%-4% w/w sorbitan monolaurate, 2%-5% w/w polyoxyethylene 20 sorbitan monolaurate, and a food grade preservative.

The food grade lubricant composition may include one or more of the following features.

The food grade lubricant composition may have a coefficient of friction between an acetal surface and a polyethylene terephthalate container of 0.08-0.17.

The food grade preservative may include 0.001% to 0.1% citric acid and 0.001% to 0.1% benzoate salt.

The food grade lubricant composition may have a pH of 3-5.

The food grade lubricant composition may have 2%-3% w/w polyalphaolefin 4, 2%-3% w/w sorbitan monolaurate, and 3%-5% w/w polyoxyethylene 20 sorbitan monolaurate.

The food grade lubricant composition may be substantially free from silicone and mineral oil.

An example of a method of making a food grade lubricant composition includes mixing, in a first container, water and a food grade preservative to form a first mixture. In a second container polyalphaolefin 4, sorbitan monolaurate, and polyoxyethylene 20 sorbitan monolaurate are mixed to form a second mixture. The second mixture is heated to 110-130 F. The first mixture and second mixture are combined to form the food grade lubricant composition.

This method may include one or more of the following features.

The food grade lubricant composition may have a coefficient of friction between an acetal surface and a polyethylene terephthalate container of 0.08-0.17.

The food grade preservative may include 0.001% to 0.1% citric acid and 0.001% to 0.1% benzoate salt.

The food grade lubricant composition may have a pH of 3-5.

The food grade lubricant composition may have 2%-3% w/w polyalphaolefin 4, 2%-3% w/w sorbitan monolaurate, and 3%-5% w/w polyoxyethylene 20 sorbitan monolaurate.

Combining the first mixture and second mixture to form the food grade lubricant composition may be performed while the second mixture is still heated.

The food grade lubricant composition may be substantially free from silicone and mineral oil.

An example of a method of lubricating a conveyor that carries food containers includes applying a food grade lubricant composition to the conveyor. The food grade lubricant composition includes 85%-95% w/w water, 1%-4% w/w polyalphaolefin 4, 1%-4% w/w sorbitan monolaurate, 2%-5% w/w polyoxyethylene 20 sorbitan monolaurate, and a food grade preservative.

This method may also include one or more of the following features.

Applying a food grade lubricant composition to the conveyor may be performed without diluting the food grade lubricant composition.

The conveyor may be acetal and the food containers may be polyethylene terephthalate.

The food grade lubricant composition may have a coefficient of friction between an acetal surface and a polyethylene terephthalate container of 0.08-0.17.

The food grade preservative may include 0.001% to 0.1% citric acid and 0.001% to 0.1% benzoate salt.

The food grade lubricant composition may have a pH of 3-5.

The food grade lubricant composition may have 2%-3% w/w polyalphaolefin 4, 2%-3% w/w sorbitan monolaurate, and 3%-5% w/w polyoxyethylene 20 sorbitan monolaurate.

The food grade lubricant composition is substantially free from silicone and mineral oil.

The food grade lubricant composition and methods may also include any combination of these features.

DETAILED DESCRIPTION

This disclosure describes certain examples and features, but not all possible examples and features of the lubricant composition and related methods. Where a particular feature is disclosed in the context of a particular example, that feature can also be used, to the extent possible, in combination with and/or in the context of other examples. The lubricant composition and related methods may be embodied in many different forms and should not be construed as limited to only the features or examples described here.

The lubricant composition is useful for conveying containers in a food or beverage facility. The lubricant composition includes food grade materials that aid in reducing the coefficient of friction (COF) between a conveyor and food containers travelling on the conveyor. The lubricant composition provides improved movement of the containers and reduces the likelihood of damage to the containers and/or conveyor.

Conveyors used in food-processing plants are typically made of stainless steel and/or plastics. Acetal conveyor belts are widely used in food processing plants because acetal has natural lubricity, a relatively low coefficient of friction, and can withstand wet conditions.

Certain examples of containers used in food processing may be made of glass, metal, wax-coated cardboard, and/or plastic. Examples of commonly used food container plastics are PET (polyethylene terephthalate) and HDPE (high density polyethylene).

The lubricant composition is described below in terms of the % w/w, or weight percent, of the specified ingredient relative to the weight of the finished lubricant composition.

The lubricant composition is composed of food grade ingredients. Food grade ingredients are approved by the United States Food and Drug Administration as either being Generally Recognized as Safe and/or suitable for use with incidental food contact, under Title 21 of the Code of Federal Regulations in place in October 2023.

The primary solvent in the composition is water, such as deionized water for example. Water is also the predominant ingredient in the lubricant composition. The lubricant composition includes water in an amount of 50% w/w to 95% w/w, 60% w/w to 95% w/w, 70% w/w to 95% w/w, 80% w/w to 95% w/w, or 85% w/w to 95% w/w.

The primary lubricating ingredient in the composition is polyalphaolephin 4 (PAO 4), which is used in automotive lubricants. Certain examples of the lubricant composition include PAO 4 in an amount of 0.5% w/w to 5% w/w, 1% w/w to 4% w/w, or 2% w/w to 3% w/w. Although this is a low concentration of PAO 4, the lubricant composition is still effective to lubricate food containers and achieve a desired coefficient of friction.

Because PAO 4 is not water soluble, other ingredients are added to form a PAO 4/water emulsion. It was difficult to prepare a stable PAO 4/water emulsion using only food-grade ingredients. A stable emulsion was achieved using an emulsifier including two food grade emulsifiers: sorbitan monolaurate and polyoxyethylene 20 sorbitan monolaurate (POE-20 sorbitan monolaurate).

The lubricant composition includes sorbitan monolaurate in an amount of 0.5% w/w to 5% w/w, 1% w/w to 4% w/w, or 2% w/w to 3% w/w.

The lubricant composition includes POE-20 sorbitan monolaurate in an amount of 0.5% w/w to 7% w/w, 1% w/w to 6% w/w, 2% w/w to 5% w/w, or 3% to 5% w/w.

The lubricant composition may include a food grade preservative. One possible example of a food grade preservative is a combination of an organic acid and a benzoate salt.

The organic acid may be a carboxylic acid, such as citric acid or the like. In certain examples, the lubricant composition includes the organic acid in an amount of 0.001% w/w to 0.1% w/w, 0.001% w/w to 0.08% w/w, 0.001% w/w to 0.06% w/w, 0.01% w/w to 0.1% w/w, or 0.02% w/w to 0.06% w/w.

The benzoate salt may be sodium benzoate or the like. In certain examples, the lubricant composition includes the benzoate salt in an amount of 0.001% w/w to 0.1% w/w, 0.001% w/w to 0.09% w/w, 0.01% w/w to 0.1% w/w, or 0.02% w/w to 0.06% w/w.

The lubricant composition may be prepared by mixing the ingredients together in one or more containers. In one example, the water and preservative are mixed in a first container until the solution becomes clear. In a second container, the sorbitan monolaurate, polyoxyethylene 20 sorbitan monolaurate, and the PAO 4 are mixed and heated to a temperature of 100-150 F, 110-130 F, or about 120 F. The mixture in the second container may be cloudy. The heated contents of the second container are mixed with the contents of the first container to yield the lubricant composition.

The lubricant composition is a stable microemulsion that is substantially clear and translucent. The pH of the lubricant composition is acidic from 2-6 or 3-5. The acidic pH does not damage the beverage container and helps the benzoate salt inhibit microbial growth of bacteria, mold and, or yeast.

In use, the lubricant composition may be applied to a conveyor by continuous or intermittent application. For example, the lubricant composition may be applied for about 10-30 seconds, not applied for about 60-120 minutes, then applied for about 10-30 seconds. This process may be repeated or adjusted based on the level of lubrication needed. A film of the lubricant composition remains in place for an extended period, allowing for minimal use of the composition and reducing the amount of water used when compared to using a traditional water dilutable conveyor lubricant that is applied constantly as the conveyors move.

The lubricant composition may be applied to the conveyor as is, meaning it is not necessary to dilute the lubricant composition before using it.

The lubricant composition may be substantially free from silicone or mineral oil. As used herein "substantially free" means from 0% w/w to 0.5% w/w.

The lubricant composition may be applied to the conveyor by being sprayed through a nozzle, by brush, or by roller for example. If sprayed, the lubricant composition may be sprayed under pressure using compressed gas or the like, or it may be sprayed without using the aid of compressed gas or another mechanism of pushing the lubricant composition out of the nozzle under increased pressure.

Examples

These examples are provided to illustrate particular examples of the lubricant composition and its uses.

Example 1: Preparing a Lubricant Composition

A lubricant composition having the ingredients shown in Table 1 was prepared by the process described below.

TABLE 1

Example of a Lubricant Composition

| Material | % w/w |
|---|---|
| Deionized Water | 91.21 |
| Citric Acid | 0.04 |

TABLE 1-continued

| Example of a Lubricant Composition | |
|---|---|
| Material | % w/w |
| Sodium benzoate | 0.05 |
| Sorbitan Monolaurate | 2.55 |
| POE-20 Sorbitan Monolaurate | 3.65 |
| Polyalphaolefin (PAO) 4 | 2.50 |
| Total | 100% |

In a first tank, deionized water, citric acid, and sodium benzoate were mixed at room temperature until the solution became clear.

In a second tank, sorbitan monolaurate, POE-20 sorbitan monolaurate, and PAO-4 were heated to 120 F. This mixture was cloudy.

The warm contents of the second tank were mixed with the contents of the first tank to yield a stable microemulsion that was clear, translucent, and had a pH of about 4.0. The pH helps sodium benzoate function as a preservative and inhibit microbial growth of bacteria, mold, and yeast.

Example 1: Coefficient of Friction Testing

The lubricant composition of Example 1 was tested in a commercial food processing plant using different size and mass PET beverage bottles on an acetal conveyor running at 65 fpm. COF measurements were taken on different full beverage bottles having three different average masses: 520 grams, 1,701 grams, and 2882.8 grams. The COF for each container was measured three times using a force gauge. The desired COF range was 0.08-0.17.

The COF was measured using a calibrated force gauge tied to the container being tested. The force on the gauge was recorded while the conveyor was moving. The conveyor ran for about 15 seconds to stabilize the gauge before the measurement was recorded. The COF was calculated using the following equation: COF=Measured tension gf/container weight tension gf.

In the first round of tests, the conveyor was wetted with the lubricant composition. Once the conveyor was wetted, no more lubricant composition was applied, and the COF was measured. The containers with the 520 gram average mass produced an average COF of 0.097. The containers with the 1701 gram average mass produced an average COF of 0.122. The containers with the 2882.8 gram average mass produced a COF of 0.122.

In the second round of tests, the conveyor was wetted with the lubricant composition. Once the conveyor was wetted, the conveyor ran for 20 minutes without applying additional lubricant composition. After these 20 minutes passed, the COF was measured. The containers with the 520 gram average mass produced an average COF of 0.106. The containers with the 1701 gram average mass produced an average COF of 0.129. The containers with the 2882.8 gram average mass produced a COF of 0.126.

In the third round of tests, the conveyor was wetted with the lubricant composition. Once the conveyor was wet, the conveyor ran for 60 minutes without applying additional lubricant composition. After these 60 minutes passed, the COF was measured. The containers with the 520 gram average mass produced an average COF of 0.103. The containers with the 1701 gram average mass produced an average COF of 0.128. The containers with the 2882.8 gram average mass produced a COF of 0.128.

In the fourth round of tests, the conveyor was wetted with an aqueous quaternary ammonium preservative solution, which is commonly used in food processing applications. The solution was applied continuously, and the COF was measured. The containers with the 520 gram average mass produced an average COF of 0.119. The containers with the 1701 gram average mass produced an average COF of 0.135. The containers with the 2882.8 gram average mass produced a COF of 0.136.

The results show that the lubricant composition is an effective lubricant for food processing use under different conditions.

The lubricant composition and methods are not limited to the details described in connection with the example embodiments. There are numerous variations and modification of the compositions and methods that may be made without departing from the scope of what is claimed.

That which is claimed is:

1. A food grade lubricant composition comprising an emulsion including 85%-95% w/w water, 1%-4% w/w polyalphaolefin 4, 1%-4% w/w sorbitan monolaurate, 2%-5% w/w polyoxyethylene 20 sorbitan monolaurate, and a food grade preservative, wherein the food grade preservative includes citric acid and a benzoate salt and the food grade lubricant composition includes 0.001%-0.1% w/w citric acid and 0.001%-0.1% w/w benzoate salt.

2. The food grade lubricant composition of claim 1, having a coefficient of friction between an acetal surface and a polyethylene terephthalate container of 0.08-0.17.

3. The food grade lubricant composition of claim 1, having a pH of 3-5.

4. The food grade lubricant composition of claim 1, having 2%-3% w/w polyalphaolefin 4, 2%-3% w/w sorbitan monolaurate, and 3%-5% w/w polyoxyethylene 20 sorbitan monolaurate.

5. The food grade lubricant composition of claim 1, being substantially free from silicone and mineral oil.

6. A method of making a food grade lubricant composition, the method comprising:

mixing, in a first container, water and a food grade preservative to form a first mixture;

mixing, in a second container, polyalphaolefin 4, sorbitan monolaurate, and polyoxyethylene 20 sorbitan monolaurate to form a second mixture;

heating the second mixture to 110-130 F; and combining the first mixture and second mixture to form the food grade lubricant composition.

7. The method of making a food grade lubricant composition of claim 6, wherein the food grade lubricant composition has a coefficient of friction between an acetal surface and a polyethylene terephthalate container of 0.08-0.17.

8. The method of making a food grade lubricant composition of claim 7, wherein the food grade preservative includes citric acid and a benzoate salt and the food grade lubricant composition includes 0.001%-0.1% w/w citric acid and 0.001%-0.1% w/w benzoate salt.

9. The method of making a food grade lubricant composition of claim 6, wherein the food grade lubricant composition has a pH of 3-5.

10. The method of making a food grade lubricant composition of claim 6, wherein the food grade lubricant composition has 2%-3% w/w polyalphaolefin 4, 2%-3% w/w sorbitan monolaurate, and 3%-5% w/w polyoxyethylene 20 sorbitan monolaurate.

11. The method of making a food grade lubricant composition of claim 6, wherein combining the first mixture and the second mixture to form the food grade lubricant composition is performed while the second mixture is still heated.

12. The method of making a food grade lubricant composition of claim 6, wherein the food grade lubricant composition is substantially free from silicone and mineral oil.

13. A method comprising lubricating a conveyor that carries food containers by applying a food grade lubricant composition to the conveyor, the food grade lubricant composition including 85%-95% w/w water, 1%-4% w/w polyalphaolefin 4, 1%-4% w/w sorbitan monolaurate, 2%-5% w/w polyoxyethylene 20 sorbitan monolaurate, and a food grade preservative, wherein the food grade preservative includes citric acid and a benzoate salt and the food grade lubricant composition includes 0.001%-0.1% w/w citric acid and 0.001%-0.1% w/w benzoate salt.

14. The method of claim 13, wherein applying a food grade lubricant composition to the conveyor is performed without diluting the food grade lubricant composition.

15. The method of claim 13, wherein the conveyor is acetal and the food containers are polyethylene terephthalate.

16. The method of claim 13, wherein the food grade lubricant composition has a coefficient of friction between an acetal surface and a polyethylene terephthalate container of 0.08-0.17.

17. The method of claim 13, wherein the food grade lubricant composition has a pH of 3-5.

18. The method of claim 13, wherein the food grade lubricant composition has 2%-3% w/w polyalphaolefin 4, 2%-3% w/w sorbitan monolaurate, and 3%-5% w/w polyoxyethylene 20 sorbitan monolaurate.

19. The method of claim 13, wherein the food grade lubricant composition is substantially free from silicone and mineral oil.

* * * * *